United States Patent [19]

Poldervaart

[11] Patent Number: 4,907,996

[45] Date of Patent: Mar. 13, 1990

[54] MOORING SYSTEM

[75] Inventor: Leendert Poldervaart, La Turbie, France

[73] Assignee: Single Buoy Moorings Inc., Marly, Switzerland

[21] Appl. No.: 318,143

[22] Filed: Mar. 2, 1989

[30] Foreign Application Priority Data

Apr. 11, 1988 [NL] Netherlands ..... 8800932

[51] Int. Cl.[4] ..... B63B 22/02

[52] U.S. Cl. ..... 441/3; 114/230

[58] Field of Search ..... 114/230, 293; 441/3-5

[56] References Cited

U.S. PATENT DOCUMENTS 4,351,260 9/1982 Tuson et al. ..... 114/230
4,534,740 8/1985 Poldervaart ..... 441/4
4,802,432 2/1989 Poldervaart et al. ..... 441/3

FOREIGN PATENT DOCUMENTS 2201930 9/1988 United Kingdom ..... 441/3

*Primary Examiner*—Joseph F. Peters, Jr.
*Assistant Examiner*—Jesûs D. Sotelo
*Attorney, Agent, or Firm*—Young & Thompson

[57] ABSTRACT

Mooring system, comprising a ship, a mooring device, a rigid arm between ship and mooring device, which arm at one end is connected to the ship or mooring device through the intermediance of a first weight loaded connecting element, which is swingably suspended, whereas according to the invention the other end is coupled to a second weight loaded connecting element, which by its weight is held in a predensioned state aginst an abutment, such that only after a certain shift of the ship the second weight starts to function. The points of attachment of the ends of the rigid arm with the weight loaded connecting elements can be past the respective centres of gravity of the weights.

3 Claims, 2 Drawing Sheets

MOORING SYSTEM

The invention relates to a mooring system, comprising a mooring device, a ship, and between mooring device and ship a rigid arm the two ends of which are fixed to a connecting element loaded by a weight, one of these connecting elements being coupled to the mooring device, and the other to the ship.

Such a mooring system is known from Dutch Patent Application 7901416, laid open and published under No. 173,254. It concerns keeping two floating bodies apart, for example a ship from a buoy. The two weights on either side of the rigid arm are suspended from connecting elements of equal length which are formed by chains.

This Patent Application 173,254 also discloses a mooring system in which the rigid arm is fastened to the mooring device, such as a buoy, with one end pivoting about a horizontal axis, while the other end is fastened to a flexible connecting element hanging down vertically from the ship and loaded by a weight. The principle on which this is based has been translated into many different embodiments, for example, placing arm and weight at water surface level, as published in Dutch Patent Application 8202335, laid open for inspection, or hingedly fastening the rigid arm to the ship and fastening the weighted connecting element to a tower, as known from, for example, U.S. Pat. No. 4,351,260. In all these variants based on the principle of FIG. 1 of Application 173,254 the unit made up of rigid arm, weight and connecting element forms a single spring which, when the ship shifts relative to the mooring device, produces an increasing degree of restoring force derived from the vertical force in the connecting element exerted by the weight.

In the mooring system of the type mentioned in the preamble, with two weights and two connecting elements, there are two springs but, going by the drawing of FIG. 2 of the published Application 173,254, they are equal in characteristic.

The object of the invention then is to produce a mooring system in which the two springs go into action in succession rather than simultaneously, and this object is organized according to the invention bY the fact that at least one of the ends of the rigid arm is coupled to a connecting element which is held in a pretensioned state by the weight, in such a way that said weight cannot be displaced until after the spring formed by connecting element and weight at the other end of the rigid arm has undergone a certain shift. Thus, when one end of the rigid arm is coupled in the normal manner by means of a weighted connecting element either to the mooring device or to the ship, this first spring will go into action first of all when the ship shifts away from the mooring device, and will produce a restoring force. The second spring will not go into action until this restoring force has reached a specific value.

In a spring system formed by a rigid arm, a weight and a connecting element hanging down vertically in the initial position, the curve showing the relationship between the pulling force in the rigid arm, arising from the shift, on the one hand, and the weight, on the other, becomes steeper with increasing shift. Now using a second spring which does not go into action until later means that at a point of the curve which indicates the relationship between shift and load, i.e. at a point which is preferably situated where the curve is becoming too steep, the second spring will begin with an initially relatively flat curve, so that the increasing rigidity of the second spring does not take place until there is a considerably greater shift.

The design is kept simple by placing the springs apart, i.e. one at the ship and the other at the mooring device.

It is pointed out that from the published Dutch Patent Application 8603241 it is known in a mooring system between two floating bodies or a floating body such as a ship and a tower to use two springs which go into action in succession, but in this case the two springs are located at one of the two devices, in particular at the ship. Use is made here of a rigid arm, one end of which is hingedly connected to the mooring device, while the other end carries the weight and is connected to the tensionable connecting element which, when a specific angular position—again related to the shift of the ship—is exceeded lifts a weight which originally rested on a support and is therefore comparable to a pre-tensioned spring.

In the case of the invention the two spring systems are, however, spatially separated from each other through one being on the mooring device and the other on the ship.

This provides a further design advantage if one end of the rigid arm is made to act upon the weight at a point which is past the center of gravity of the weight, viewed from the other end of the arm; a principal which is known per se from European Patent Application 0,188,840, laid open for inspection. According to the invention, the rigid arm can now also be made to act upon the pretensioned weight at a point which is past the centre of gravity of the pre-tensioned weight, viewed in the other direction, when said weight is in its initial position. Making the rigid arm act in this way upon the weight at a point past the centre of gravity rather than at the weight itself means that the curve showing the relationship between shift and load runs shallower after an initial rise, before a further rise takes place. This flatter curve is significant because in certain circumstances it is desirable that when the shifts of the ship take place, shifts which as a result of the waves exhibit a to and from picture, the spring does not become rigid too quickly, but has a part of its characteristic in which the spring has a constant characteristic or a weak characteristic.

If this principle is now applied at both ends of the rigid arm, and thus also at the pre-tensioned spring, an even better load/shift curve is obtained, because at the end of the weak spring area of the first spring and before it becomes rigid the second spring also goes into action with a comparable characteristic, which means that a very long range of shifts can be obtained without overloading occurring in the whole connection.

Fitting the two spring systems on either side of the rigid arm also makes it possible to accommodate the two weights in areas which are separated from the surface water. For example, one of the weights can be in a mooring device designed as a tower and can be connected to the rigid arm by means of a pivoting arm, while the other weight can be accommodated inside the ship on an arm which is fixed to a horizontal shaft whose ends project beyond the hull and are provided there with levers, which are in turn connected to the rigid arm.

The invention will now be explained in greater detail with reference to the drawings.

Figure 1:
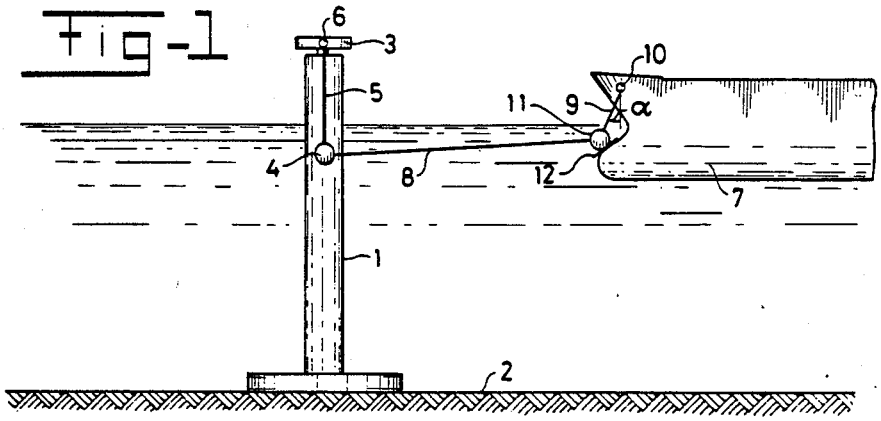
FIG. 1 shows schematically in side view a first embodiment of the mooring system according to the invention.

In FIG. 1 the mooring device is a tower 1 which is fixed to the seabed 2. This tower has at its top end a rotary table 3, from which weights 4 are suspended at either side of the tower by means of chains or bars 5, the top ends of which are hingedly fastened at 6 to the rotary table 3.

The ship is indicated by 7, and between ship and mooring device is a rigid arm 8, which at the weight 4 is hingedly connected to the bars 5 and at the other end is hingedly connected to an arm or set of arms 9, which are hingedly fastened at 10 to the bow of the ship, and to which a weight 11 resting on a bearing face 12 on the bow of the ship is fastened. The bars or arms 9 in the initial position shown in FIG. 1 are in an angular position relative to the vertical, indicated by the angle $\alpha$.

When with this mooring system the ship 7 shifts relative to the tower 1, the weight 4 will be moved first of all and with increasing angle of the bars 5 will create a restoring force in the arm 8.

Figure 4:
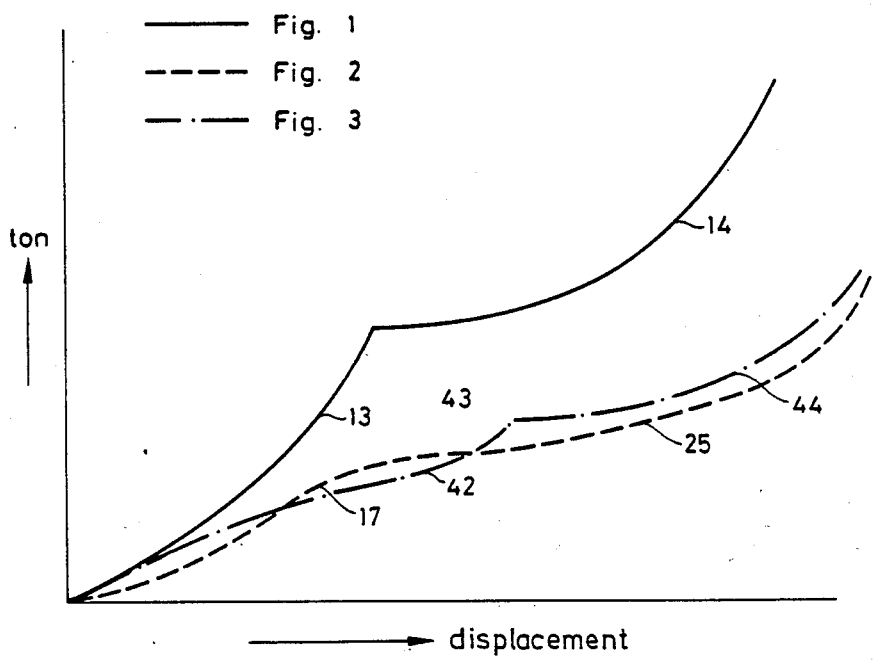
FIG. 4 shows a graph of the load relative to the shift for the respective systems shown in FIGS. 1, 2 and 3.

In FIG. 4 this is the first part of the curve indicated by solid lines, said part being indicated by 13.

When a certain shift is reached the weight 11 will also be lifted from its support 12, i.e. the angle $\alpha$ increases. The second spring thus then goes into action, and this is indicated in FIG. 4 by the part 14 of the curve indicated by solid lines.

Figure 2:
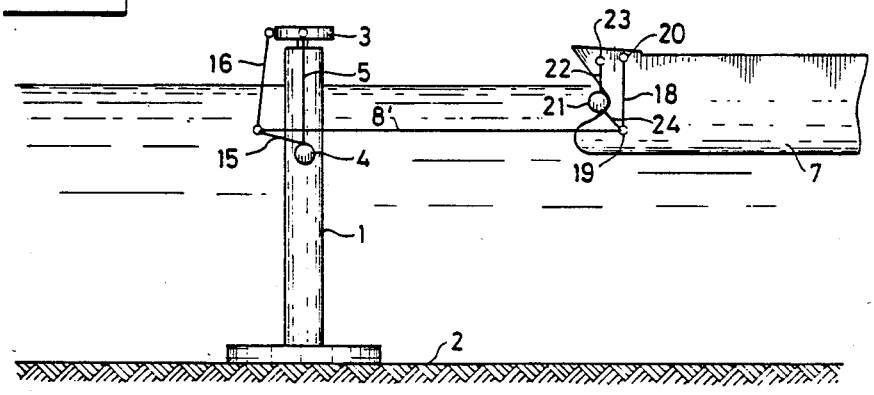
FIG. 2 shows schematically in side view a second embodiment.

In the embodiment of FIG. 2 the weight 4 is suspended in the same way as in FIG. 1 by bars 5 from a rotary table 3 which is at the top end of the column 1. However, the rigid arm 8' now acts upon the weight via a compression-resistant connection 15 and the point of application is itself suspended from the rotary table 3 by means of a flexible or swivelling connecting element 16. This spring provides the first part 17 of the curve indicated by dotted lines in FIG. 4.

In this embodiment shown in FIG. 2 the ship 7 is fitted with two connecting elements. The connecting element 18 bears the end 19 of the rigid arm 8' and is suspended at 20 from the ship.

The weight 21 is suspended from the bow of the ship at 23 by means of a separate connecting element 22. This weight also rests against a stop face on the bow, and the pre-tension can be created either by the mass of the weight 21 or by giving the bars 22 an angular position.

A compression-proof connection 24 is again provided between the connecting point 19 and the weight 21.

The way in which this system works is found in the second part of the curve indicated by dotted lines, said part having the reference number 25.

Figure 3:
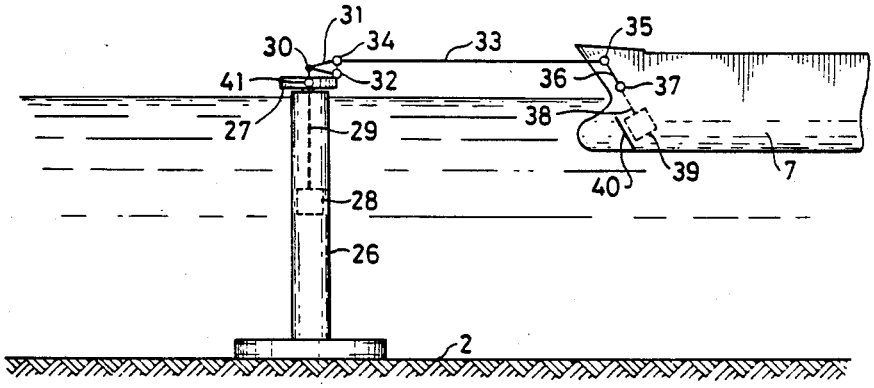
FIG. 3 shows a third embodiment.

In the embodiment of FIG. 3 the mooring device comprises a tower 26, which at the top end is provided with a rotary table 27. The tower is hollow, and the hollow part contains a weight 28 which is suspended from a cable 29 whose top end is fastened at 30 to a triangular rigid yoke 31, which at 32 has a hinge pin on the rotary table. The rigid arm 33 is hingedly connected to said yoke at 34, while the other end is connected at 35 to the top ends of arms 36 located on either side of the bow and fixed to a horizontal shaft 37 mounted in the bow. An arm 38 having a weight 39 which rests against a bearing face 40 is fixed to this horizontal shaft inside the ship.

The chain 29 or cable 29 is conveyed inside the rotary table over a pulley 41. In this embodiment the rigid yoke 31 will also be able to produce a flattening curve, indicated by the first part 41 of the curve indicated by dotted and dashed lines in FIG. 4, when the first spring formed by the weight 28 goes into action.

A straight curve is, however, also possible here depending on the way in which the shifts of the rigid arm 33 are transferred to the weight 28. The other end of the rigid arm 33 acts upon the lever 36, 38 and the spring formed by the weight 39 fastened thereto and this lever provides a second spring which goes into action when the force occurring has reached a specific level, for example, at the point 43 in the curve, which is indicated by dotted and dashed lines, following which this second spring ensures a curve such as that indicated by the part 44.

It will be clear that the mooring device shown in the drawing does not have to be a column. Other systems are conceivable here.

It will also be clear that a great variation in the dimensions of the spring system at the ship is possible.

I claim:

1. Mooring system, comprising a mooring device, a ship, and between mooring device and ship a rigid arm each of the two ends of which is fixed to a connecting element loaded by a weight, one of these connecting elements being coupled to the mooring device, and the other to the ship, characterized in that at least one of the ends of the rigid arm is coupled to a connecting element which is held in a pre-tensioned state by the weight, in such a way that said weight cannot be displaced until after the connecting element and weight at the other end of the rigid arm have undergone a certain shift.

2. Mooring device according to claim 1, in which one end of the rigid arm acts upon the weight at a point which is past the centre of gravity of the weight, viewed from the other end of the arm, characterized in that the rigid arm now also acts upon the weight at the other end of the arm at a point which is past the centre of gravity of the latter weight, viewed in the other direction, when said latter weight is in its initial position.

3. Mooring device according to claim 1, characterized in that the two weights are in an area which is spaced from the surface of the water.

* * * * *